US007192321B2

(12) United States Patent
Maselter

(10) Patent No.: US 7,192,321 B2
(45) **Date of Patent: *Mar. 20, 2007**

(54) MARINE INBOARD/OUTBOARD SYSTEM

(76) Inventor: John F. Maselter, 31 Montecillo, Rolling Hills Estate, CA (US) 90274

( * ) Notice: Subject to any disclaimer, the term of this patent is extended or adjusted under 35 U.S.C. 154(b) by 0 days.

This patent is subject to a terminal disclaimer.

(21) Appl. No.: 11/404,227

(22) Filed: Apr. 13, 2006

(65) Prior Publication Data

US 2006/0189225 A1 Aug. 24, 2006

Related U.S. Application Data

(63) Continuation-in-part of application No. 10/800,276, filed on Mar. 12, 2004, now Pat. No. 7,066,777.

(51) Int. Cl.
*B63H 5/125* (2006.01)

(52) U.S. Cl. ..... 440/57; 440/83

(58) Field of Classification Search ..... 440/57, 440/83

See application file for complete search history.

(56) References Cited

U.S. PATENT DOCUMENTS

| | | | | |
|---|---|---|---|---|
| 1,735,660 | A | | 11/1929 | Svendsen et al. |
| 2,905,133 | A | | 9/1959 | Clerk |
| 3,136,281 | A | | 6/1964 | Kiekhaefer et al. |
| 3,256,851 | A | | 6/1966 | Ackerman |
| 3,296,997 | A | | 1/1967 | Hoiby et al. |
| 3,404,656 | A | | 10/1968 | Chamberlain |
| 3,599,595 | A | | 8/1971 | James |
| 3,626,467 | A | | 12/1971 | Mazziotti |
| 3,631,671 | A | | 1/1972 | Reynolds |
| 3,933,116 | A | * | 1/1976 | Adams et al. ..... 440/57 |
| 4,304,556 | A | | 12/1981 | Wilson |
| 4,373,921 | A | | 2/1983 | Hall et al. |
| 4,713,029 | A | | 12/1987 | Ford |
| 4,728,306 | A | | 3/1988 | Schneider |
| 4,764,136 | A | | 8/1988 | Johansson |
| 4,840,589 | A | | 6/1989 | Breaux |
| 4,925,413 | A | | 5/1990 | Newman et al. |
| 4,925,414 | A | | 5/1990 | Newman |
| 5,045,001 | A | | 9/1991 | Borst |
| 5,049,099 | A | | 9/1991 | Ito et al. |
| 5,279,509 | A | | 1/1994 | Gifford |
| 5,340,345 | A | | 8/1994 | Brodbeck et al. |
| 5,529,519 | A | | 6/1996 | Nakamura et al. |
| 5,647,780 | A | * | 7/1997 | Hosoi ..... 440/53 |
| 6,024,617 | A | | 2/2000 | Smullin et al. |
| 6,048,235 | A | | 4/2000 | Kai |
| 6,267,632 | B1 | | 7/2001 | Blanchard |

(Continued)

*Primary Examiner*—Stephen Avila
(74) *Attorney, Agent, or Firm*—Christie, Parker & Hale LLP

(57) ABSTRACT

An improved marine vessel includes a hull, the hull including a transom and having a predetermined waterline intersecting the hull and the transom. The vessel further includes an upper driveshaft disposed above the waterline, an engine disposed within the hull including an engine drive shaft, and a transmission shaft. The transmission shaft is configured to operatively couple the engine drive shaft to the upper drive shaft. The transmission shaft extends in an inclined orientation relative to a bottom of the hull between the engine drive shaft and the upper drive shaft. The vessel includes a stern drive attached to the transom, wherein the stern drive operatively couples the upper drive shaft to a propeller.

20 Claims, 7 Drawing Sheets

U.S. PATENT DOCUMENTS 6,296,535 B1 10/2001 Bland et al.
6,299,496 B1 10/2001 Griffiths et al.
6,368,168 B1 4/2002 Funami
6,406,344 B1 6/2002 Bland et al.
6,572,421 B2 6/2003 Sadakata
6,971,932 B2 * 12/2005 Maselter ..... 440/83
2002/0115359 A1 8/2002 Bland et al.

* cited by examiner

MARINE INBOARD/OUTBOARD SYSTEM

RELATED APPLICATIONS

The present application is a continuation-in-part of U.S. patent application Ser. No. 10/800,276, filed Mar. 12, 2004, issued as U.S. Pat. No. 7,066,777.

FIELD OF THE INVENTION

The present invention relates generally to marine inboard/outboard systems. More particularly, this invention relates to a system featuring a stern drive that is partially out of the water when in use and/or can be easily and completely lifted out of the water when not in use without the need to remove the stern drive from the vessel or the vessel from the water.

BACKGROUND OF THE INVENTION

Internal combustion marine drive systems come in several basic types, distinguished by the placement and articulation of the engine and drivetrain components. Differing choices in the layout of these components yield varying results in reliability, performance and ease of maintenance of the systems as a whole.

With an inboard system, a system featured mainly on larger vessels, the engine and almost all of the drivetrain components are placed inside the hull of the vessel towards the bottom, at or below the waterline. The engine and transmission are situated roughly equidistant from the bow, stern, port and starboard sides of the vessel. A propeller shaft extends rearwards from the transmission and tilts slightly downward, exiting the hull behind the inboard engine, ending underneath the bottom and towards the stern of the vessel. The engine of an inboard system can be a marinized automobile type four stroke engine or a purpose-built marine diesel and will typically have its own compartment within the hull. While an inboard engine takes up a good deal of room inside the hull that could otherwise be devoted to interior cabin space, it provides the vessel with excellent balance and a low center of gravity. In addition, the drivetrain used is generally considered the simplest and most efficient method of transferring torque from the engine to the propeller. However, because of the fixed position of the propeller shaft and reliance on a separate stern mounted rudder system, the inboard system is not as maneuverable at low speeds or while in reverse as are other systems.

In contrast an outboard system allows a user to steer by rotating the propeller shaft itself through a large arc. This is made possible by providing the engine, drivetrain and propeller all encased within a single unit externally mounted on the transom of the vessel. Because steering is achieved by rotating this unit as a whole to change the direction of thrust of the propeller, excellent low speed maneuverability is achieved. While the top portion of an outboard system contains the engine components and remains above the waterline, the bottom portion containing the drivetrain and propeller shaft extends beneath the waterline.

The placement of an outboard system on the transom of a vessel tends to make the vessel as a whole heavier at the stern. To minimize the negative effect an outboard system has on the weight balance of a vessel, these systems are designed to be lighter and more compact than an inboard system of comparable power. An outboard system of moderate size can readily be manually removed and replaced on a vessel by a single user. Outboard systems are an attractive option because of their low cost and simplicity.

As a compromise between the inboard system and the outboard system, an inboard/outboard ("I/O") system combines elements of both aforementioned systems to maximize the utility of each. In an I/O system, as with a true inboard system, the engine is placed inside the hull at or below the waterline and equidistant from the port and starboard sides of the vessel. However the I/O system differs in its placement of the engine towards the stern of the vessel near the transom. An engine driveshaft extends from the engine and exits the vessel through the transom below the waterline. The portion of an I/O system mounted externally on the transom is customarily known as the stern drive, or outdrive, and essentially resembles the lower portion of an outboard system. The stern drive receives the engine driveshaft exiting the vessel through the transom below the waterline and is attached to the transom of the vessel with six large bolts and nuts.

The interior of the stern drive contains a universal joint which enables the rotating shafts housed within the stern drive to turn in a horizontal plane and tilt in a vertical plane while transferring torque from the engine to the propeller shaft. The universal joint is necessary because the stern drive itself must be able to turn and tilt as a unit in order to steer the vessel and to trim the attitude of the vessel, respectively. As is known to those skilled in the art, the stern drive incorporates a gimble unit or other means which allow the lower portion of the unit to be adjusted in the manner described above. See, for example Bland et al U.S. Pat. No. 6,296,535, incorporated herein by reference.

Also provided are a series of gears that allow the rotating shafts inside the stern drive to connect with one another through a series of ninety degree turns. Specifically, these gears allow the engine driveshaft to connect with a vertical shaft, and further allow this vertical shaft to connect with a horizontal propeller shaft. A housing, bellows, and/or other means protect the mechanical components of the stern drive such as the aforementioned gears and universal joint from the corrosive effects of the salt water environment of the stern drive.

The advantages of an I/O system are that a large, fuel efficient automotive type four stroke or marinized diesel engine can be used as with a true inboard. The weight balance of the vessel, while not as good as with a true inboard given the aft placement of the engine, is still better than an outboard system where the weight of the engine rests entirely outside the hull of the vessel. The steering and trimming functionalities of an outboard system are preserved, as is a good deal of interior cabin space in the vessel given the sternward placement of the engine.

Despite their advantages, prior art I/O systems suffer from the notable drawback of susceptibility to failure caused by salt water damage. Because the stern drives in prior art I/O systems are permanently placed below the waterline, their interior mechanical components are vulnerable to damage caused by seawater entering the stern drive. Although bellows are provided to protect the interior mechanical components of the stern drive from the salt water environment in which the stern drive is located, leaks in said bellows do occur necessitating costly repairs for the user. Even if a leak in said bellows does not occur, it is still necessary to replace said bellows on a regular basis, which is also costly for the user.

In addition, routine maintenance tasks such as oil changes and the like can only be performed on the stern drive with the vessel itself removed from the water. Cleaning the exterior housing of the stern drive to remove algae and barnacles can only be performed with the vessel removed from the water or by a trained diver.

As described in the foregoing, a general drawback to I/O systems is the position of the engine near the stern of the vessel. Such a position places the center of gravity of the vessel toward the stern of the vessel. Accordingly, a more unbalanced load distribution is produced by typical I/O systems. The unbalanced load distribution hinders the performance of vessels having I/O systems in comparison to vessels having inboard systems. For example, vessels having an inboard system tend to plane-off better than vessels having outboard systems or I/O systems.

There exists a need for a stern drive for an I/O system that eliminates the problems stated above. It is understood that the present invention relates to a wide range of prior art I/O systems including embodiments not explicitly discussed above. For example, in an alternative embodiment of the prior art I/O system, the stern drive additionally comprises two propellers as well as mechanical means to turn two propellers in opposite directions. Otherwise, this alternative embodiment of the prior art is substantially the same as the system described above. The improved marine inboard/outboard system of the present invention is an improvement over both these embodiments of the prior art.

SUMMARY OF THE INVENTION

In accordance with one aspect of the present disclosure, an improved marine vessel includes a hull, the hull including a transom and having a predetermined waterline intersecting the hull and the transom. The vessel further includes an upper driveshaft disposed above the waterline, an engine disposed within the hull including an engine drive shaft, and a transmission shaft. The transmission shaft is configured to operatively couple the engine drive shaft to the upper drive shaft. The transmission shaft extends in an inclined orientation relative to a bottom of the hull between the engine drive shaft and the upper drive shaft. The vessel includes a stern drive attached to the transom, wherein the stern drive operatively couples the upper drive shaft to a propeller.

In accordance with another aspect of the present disclosure, an improved marine vessel includes a hull, the hull including a transom and having a predetermined waterline intersecting the hull and the transom. The vessel further includes an upper driveshaft disposed above the waterline, an engine disposed within the hull an having an engine driveshaft. The engine drive shaft has a horizontal distance and a vertical distance relative to the upper drive shaft to define an inclined distance between the upper drive shaft and the engine drive shaft. The vessel includes a transmission shaft that extends along the inclined distance, wherein the transmission shaft operatively couples the engine drive shaft to the upper drive shaft. The vessel further includes a stern drive that is attached to the transom. The stern drive includes a vertical shaft driven by the upper driveshaft, a propeller shaft driven by the vertical shaft, and a housing attached to the transom and enclosing the vertical shaft.

In accordance with yet another aspect of the present disclosure, a drive system for a marine vessel having a hull with a transom, an engine disposed within the hull and having an engine drive shaft, and a stern drive having a propeller shaft coupled to a propeller, the drive system includes an upper driveshaft configured to be disposed outside the hull and above a predetermined waterline intersecting the transom. The drive system further includes a transmission shaft that is configured to extend through an inclined distance defined by a horizontal distance and a vertical distance between the upper drive shaft and the engine drive shaft. The transmission shaft is further configured to operatively couple the engine drive shaft to the upper drive shaft. A vertical shaft is configured to operatively couple to the upper drive shaft with a set of upper gears and configured to operatively couple to the propeller shaft with a set of lower gears.

Figure 1:
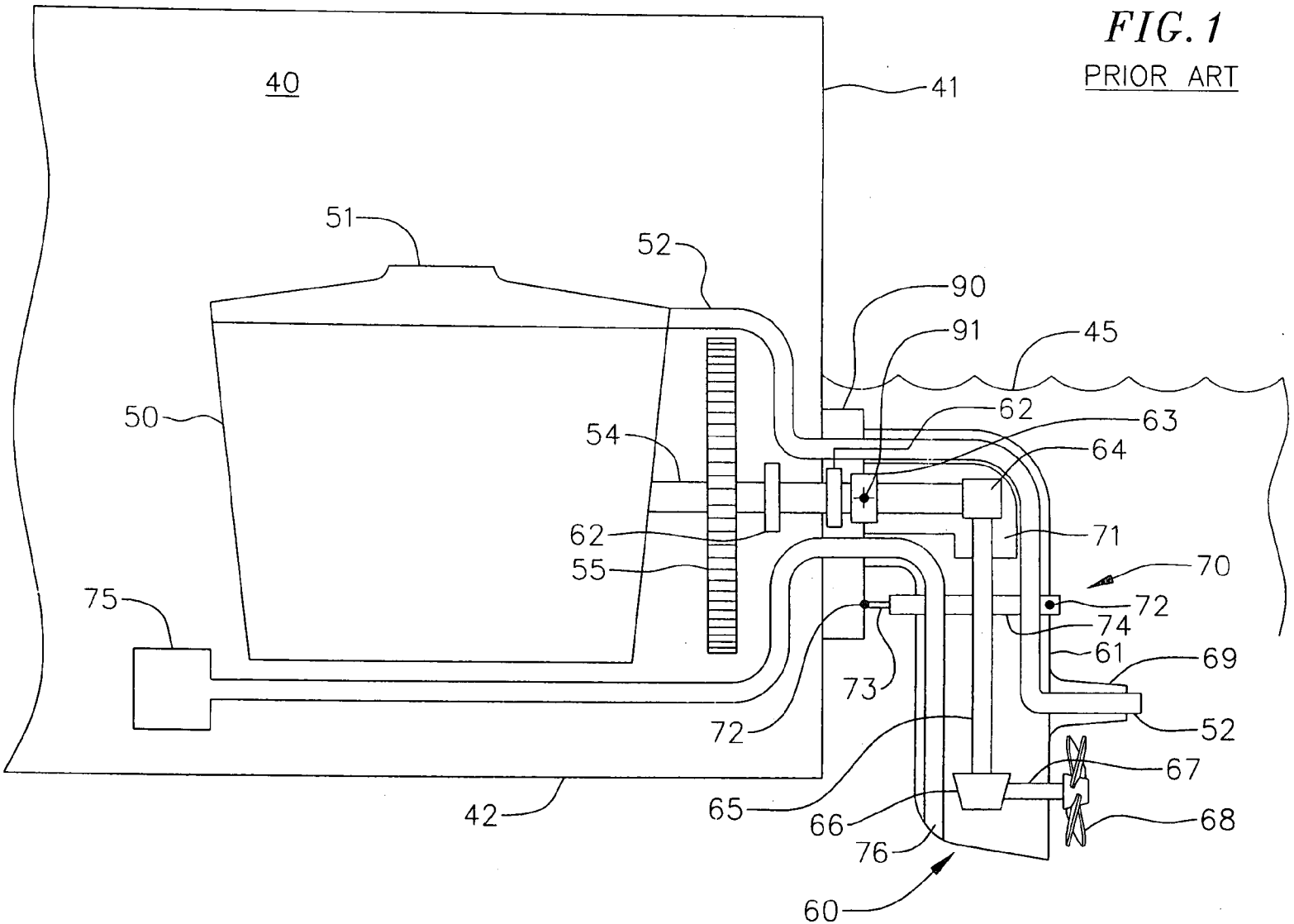
FIG. 1 PRIOR ART
FIG. 1 is a side view of a prior art stern drive having a conventional placement and articulation.

Before any embodiment of the invention is explained in detail it is to be understood that the invention is not limited in its application to the exemplary details of construction and arrangements of components set forth in the following description or illustrated in the drawings. For example, although the actuator will be described in the context of a hydraulic cylinder, it will be appreciated that in lieu of using a hydraulic actuator, an electromechanical actuator could be employed to impart the thrust required to trim the stern drive propulsion system. Thus, the invention is capable of other embodiments and of being practiced or being carried out in various ways. Also, it is to be understood that the terminology used herein is for the purpose of illustrative description and should not be regarded as limiting.

DETAILED DESCRIPTION OF THE INVENTION

Figure 3:
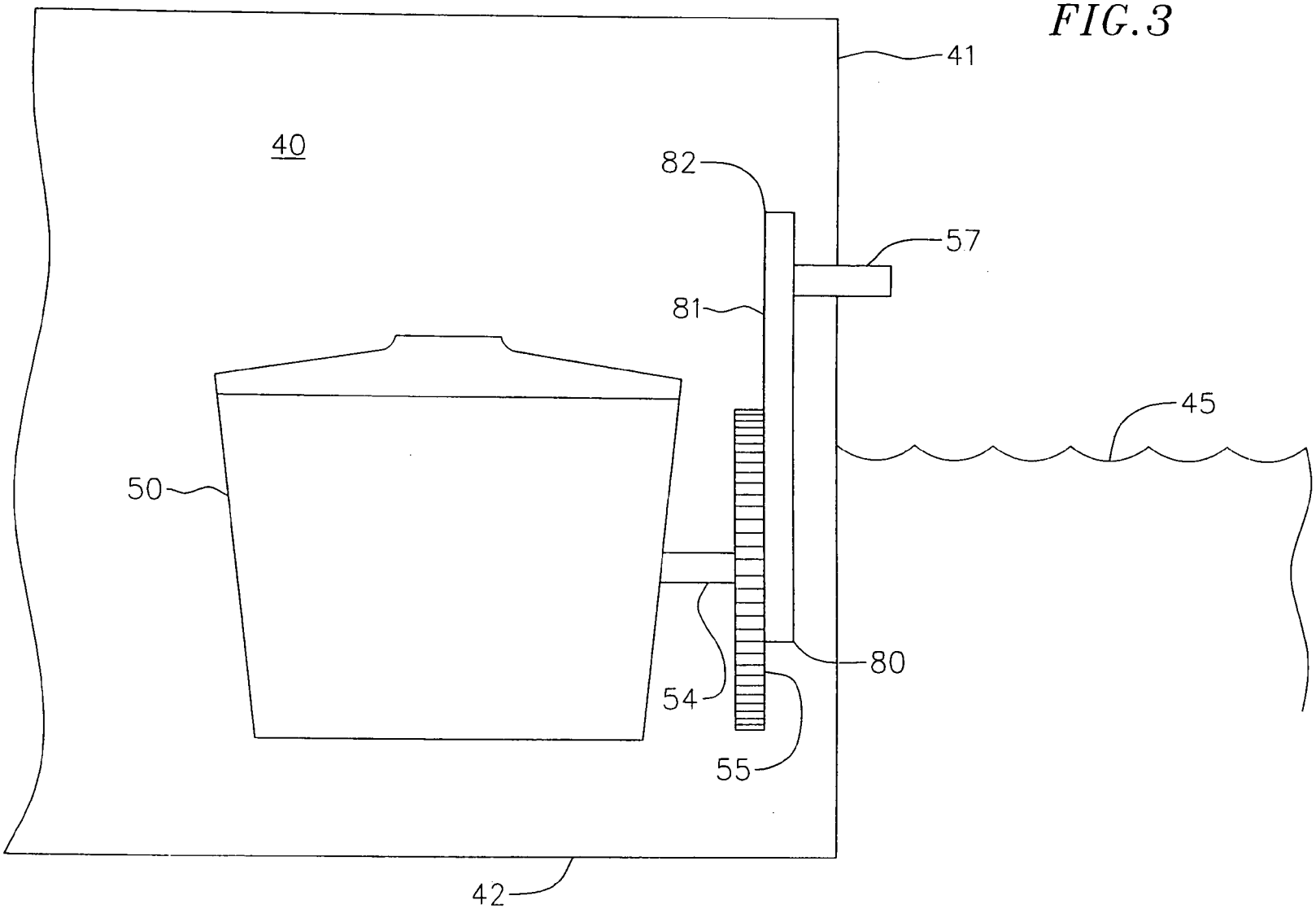
FIG. 3 is a side view of the improved stern drive of FIG. 1 using a belt and pulley system in the drivetrain.

Referring now to the drawings, and more particularly to FIG. 1, there is shown an illustration of a prior art design of an I/O system. A side view of the system is shown installed in a vessel 40 having a transom 41 and bottom hull 42. A stern drive 60 is shown comprising a stern drive mounting plate 90, a housing 61 attached to the stern drive mounting plate 90 and the components contained therein, described in detail below. The stern drive mounting plate 90 is attached to the transom 41 of the vessel 40 by six large bolts (not shown). As is known to those skilled in the art, the stern drive 60 can include a gimble unit (not shown) or other suitable means interposed between the stern drive mounting plate 90 and the housing 61 which allow the housing 61 to pivot in relation to the stern drive mounting plate 90 about a pivot 91. See gimble unit 30 of FIG. 3, in Bland et al U.S. Pat. No. 6,296,535.

An engine 50 is shown within the vessel 40 partially below the waterline 45. An engine driveshaft 54 extends from the engine 50 and connects to a flywheel 55. As is known to those skilled in the art, the flywheel 55 is used for the smooth operation of the engine 50 and can be engaged by a starter motor (not shown) when a user desires to start the engine 50.

The engine driveshaft 54 passes though the flywheel 55 and a gimble bearing 62 before passing through the transom 41 to enter the stern drive 60. For increased stability, multiple gimble bearings 62 may be used, and they may be disposed to support the upper driveshaft on either or both sides of the transom 41. The stern drive 60 is shown here completely submerged below the waterline 45. A bellows 71 is provided in the top portion of the stern drive 60 to protect the mechanical components therein, including a universal joint 63 and gears 64, from corrosion. The engine driveshaft 54 connects to the universal joint 63. The universal joint 63 connects through a shaft to the gears 64. The gears 64 connect to a vertical shaft 65 which runs downward through the housing 61 of the stern drive 60 to connect with gears 66. The gears 66 connect to a propeller shaft 67, which in turn is connected to a propeller 68.

An anti-cavitation plate 69 is part of the stern drive housing 61. An actuator 70 extends from the stern drive mounting plate 90 to engage the housing 61. The actuator is comprised of a cylinder 72 and piston 73. The actuator 70 is attached to the stern drive mounting plate 90 and the housing 61 using a pair of actuator hinges 72. The actuator hinges 72 allows the actuator 70 to change its pitch as it extends and contracts to adjust the lower portion of the stern drive 60.

The actuator 70 rotates the stern drive 60 about the universal joint 63 and gimble unit or other means known in the art, both of which allow rotation in relation to the pivot 91 of the components they connect. The universal joint pivot location may be different than the stern drive pivot 91, if desired. This actuator allows a user of the stern drive 60 to trim the attitude of the stern drive 60. This actuator also allows a user to raise the stern drive 60 so that the vessel can be held low on a trailer while ensuring ground clearance of the stern drive 60. However, the stern drive 60 cannot be lifted completely out of the water in the prior art I/O system shown in FIG. 1.

The I/O system shown in FIG. 1 also includes an exhaust conduit 52 connected to the manifold 51 of the engine 50. The exhaust conduit 52 is routed through the stern drive 60 and exits the housing 61 of the stern drive 60 through the anti-cavitation plate 69. A water pump 75 is connected to the water intake 76. The water intake 76 takes water into the stern drive 60 and passes it through the transom 41 to the interior of the vessel 40 in order to cool the engine 50.

Figure 2:
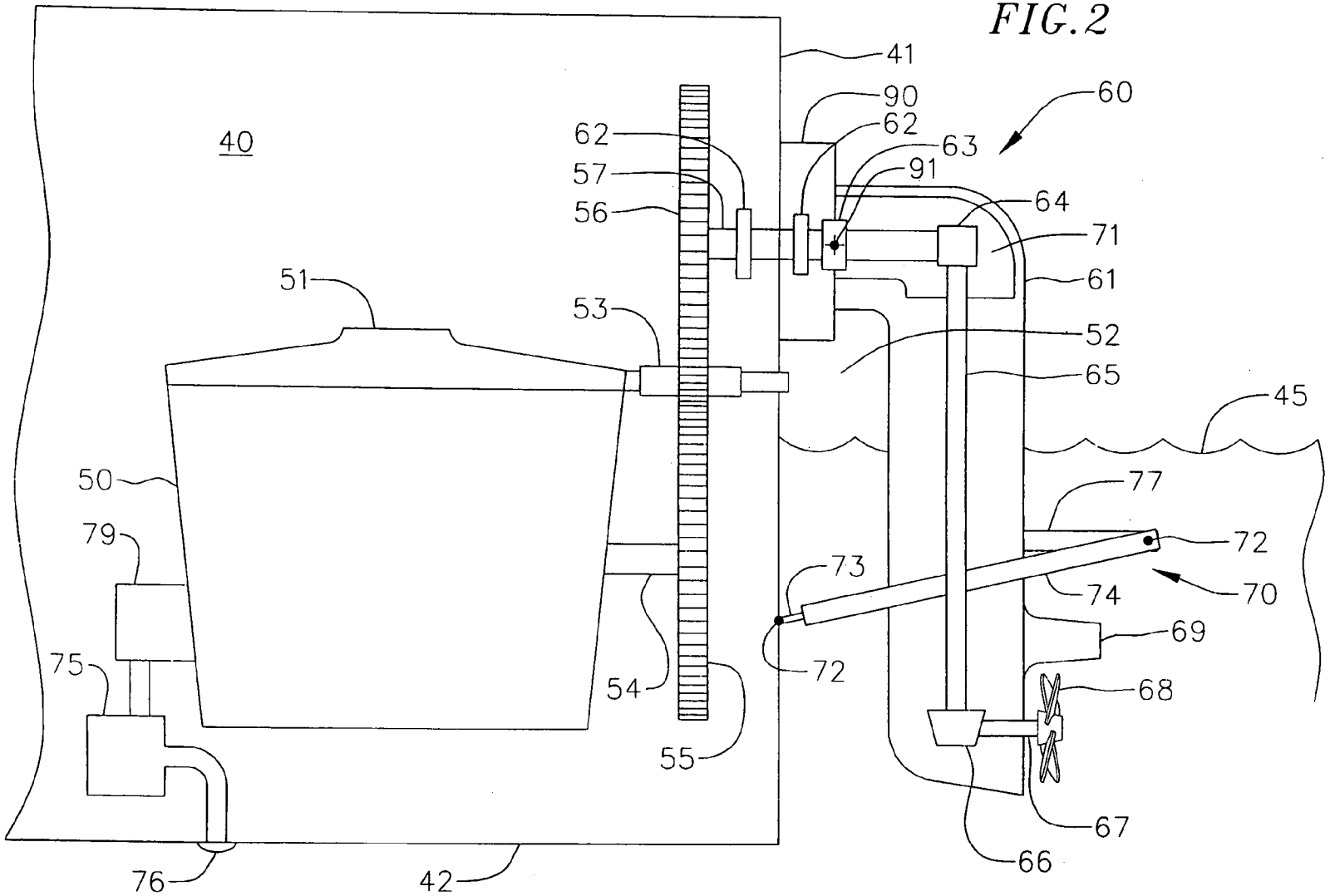
FIG. 2 is a side view of an improved stern drive configuration.

FIG. 2 shows one embodiment of the present improved marine I/O system. The stern drive 60 is shown comprising a stern drive mounting plate 90, a housing 61 and the components contained therein, described in detail below. The stern drive mounting plate 90 is attached to the transom 41 by six large nuts and bolts (not shown). As described above and known in the prior art, the stern drive 60 can include a gimble unit (not shown) or other suitable means interposed between the stern drive mounting plate 90 and the housing 61 which allow the housing 61 to pivot in relation to the stern drive mounting plate 90 about a pivot 91. An anti-cavitation plate 69 is provided as part of the housing 61.

An upper driveshaft 57 is positioned so that it exits the transom 41 of the vessel 40 above the waterline 45. The stern drive 60 is positioned on the transom 41 in turn so that the mechanical components in the top portion of the stern drive, including the universal joint 63 and gears 64, lie in the same horizontal plane as the upper driveshaft 57. This has the result that the universal joint 63 and the gears 64 will also lie above the waterline 45. Because of this, the universal joint 63 and the gears 64 are at much less risk of damage from the salt water environment. A bellows 71 may be used enclosing these components as in the prior art to further reduce this risk.

The upper driveshaft 57 passes though a gimble bearing 62 before passing through the transom 41 to enter the interior of the stern drive 60. For increased stability, multiple gimble bearings 62 may be used, and they may be disposed to support the upper driveshaft on either or both sides of the transom 41. The upper driveshaft 57 enters the interior of the stern drive 60 and engages the universal joint 63, which in turn engages the gears 64. The gears 64 connect to a vertical shaft 65 which runs downward through the housing 61 of the stern drive 60, crossing the level of the waterline 45 to connect with gears 66. The propeller shaft 67 is connected to the gears 66, and is in turn connected to the propeller 68.

The actuator 70 rotates the lower portion of the stern drive 60 about the pivot 91. The actuator 70 is comprised of a piston 73 and a cylinder 74. In the present stern drive 60, the actuator 70 extends from the transom 41 to a cantilever 77 provided attached to the housing 61. The actuator 70 is attached to the transom 41 and the cantilever 77 using a pair of actuator hinges 72. The actuator hinges 72 allow the actuator 70 to change its pitch as it extends and contracts to adjust the position of the stern drive 60.

By attaching one end of the actuator 70 to the transom 41 directly or through an actuator mounting plate (not shown) rather than to the stern drive mounting plate 90 as in the prior art, and by attaching the other end of the actuator 70 to a cantilever 77, a much longer actuator 70 can be used than in the prior art. The elongated actuator 70 of the present invention can effectively reposition the stern drive 60 between an operative position below the waterline 45 and a maintenance position wherein the stern drive 60 is lifted partially or even completely above the waterline 45. Because the stern drive 60 is mounted on the transom 41 such that the top portion of stern drive 60 lies above the waterline 45, this rotation can result in the entire stern drive 60 being above the waterline 45 when the actuator 70 is fully extended.

The I/O system shown in FIG. 2 differs from the prior art in the additional respect that the exhaust conduit 52 and the water intake 76 of the engine 50 are both routed directly through the hull of the vessel 40 and do not pass through the stern drive 60. As shown in FIG. 2, the exhaust conduit 52 runs from the manifold 51 of the engine 50 through the transom 41 above the waterline 45. The exhaust conduit 52 incorporates a muffler 53. In addition, FIG. 2 shows a water pump 75 connected to a water intake 76 which is attached to the bottom hull 42 of the vessel 40. The water pump 75 may in turn be connected to a cooling system 79 connected to the engine 50. Because of these improvements, the lower portion of the housing 61 of the stern drive 60 can be constructed as a single, watertight unit and may employ aluminum or another suitable material.

FIG. 2 shows the present stern drive 60 placed so that the portion of the stern drive 60 that attaches to the transom 41 is above the waterline. However, the engine 50 is placed at or below the waterline within the hull of the vessel 40, as is standard with I/O systems. Because the upper driveshaft 57 of the stern drive 60 is not on the same level with the engine driveshaft 54, the problem arises of how to transfer power from the latter to the former. In FIG. 2 a flywheel 55 is shown attached to the engine driveshaft 54. The flywheel 55 has teeth on it which enable it to engage drive gear 56. Drive gear 56 is in turn attached to the upper driveshaft 57, which passes through the transom 41 to the interior of stern drive 60.

Various methods may be used to allow the upper driveshaft 57 of the stern drive 60 to exit the transom 41 above the waterline 45. In an alternative embodiment shown in FIG. 3, the engine driveshaft 54 extends from the engine 50 and connects to a flywheel 55. The flywheel 55 rotatably engages a lower pulley 80. The lower pulley 80 engages a belt 81 which turns an upper pulley 82. The upper pulley 82 is connected to the upper driveshaft 57. A plurality of belts may also be used to provide redundancy and ensure the smooth operation of the system in the event of a failure of any single belt.

Figure 4:
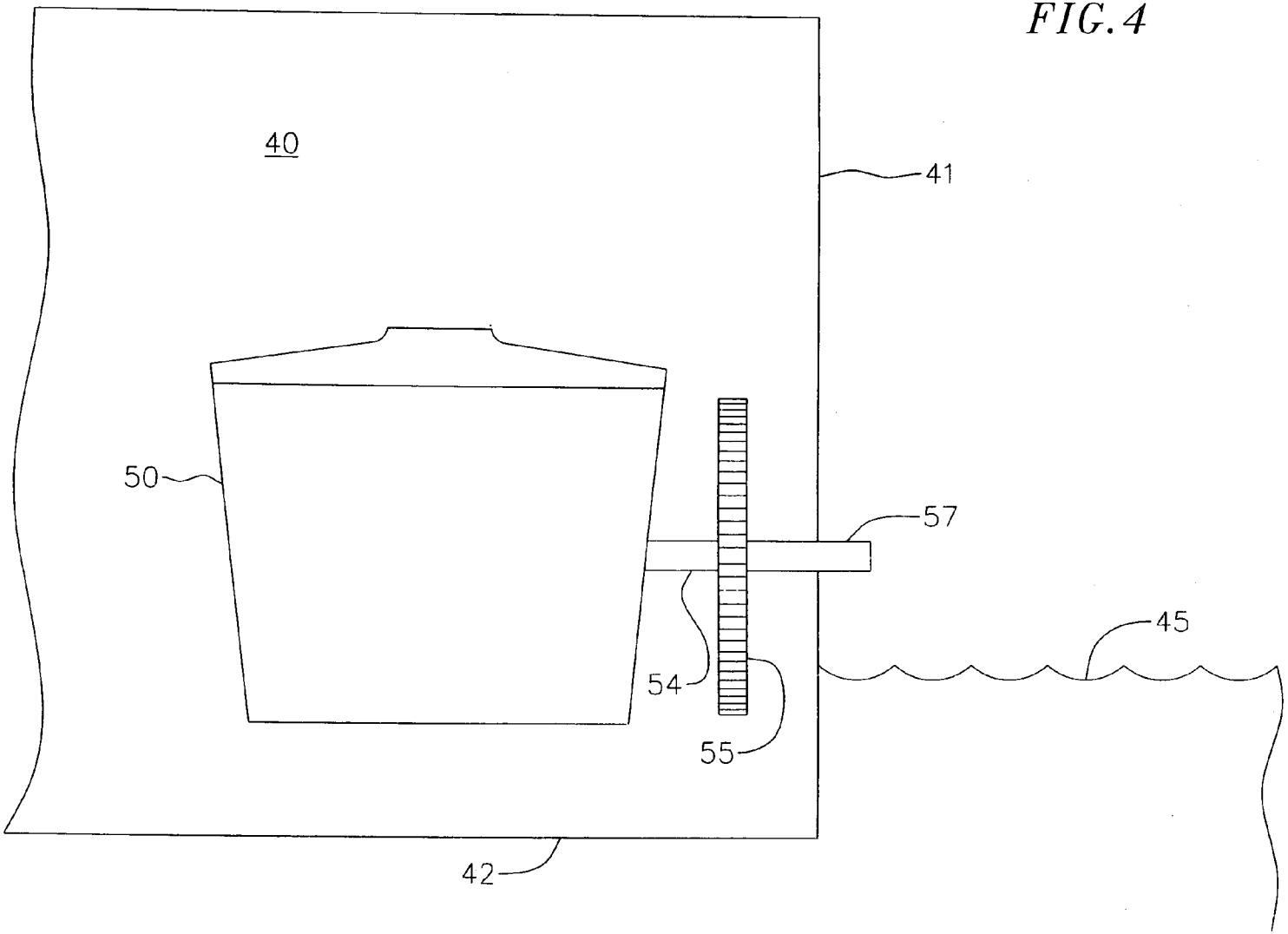
FIG. 4 is a side view of the improved stern drive of FIG. 1 wherein the engine is placed on the same level as the top portion of the stern drive for a simplified drivetrain.
Figure 5:
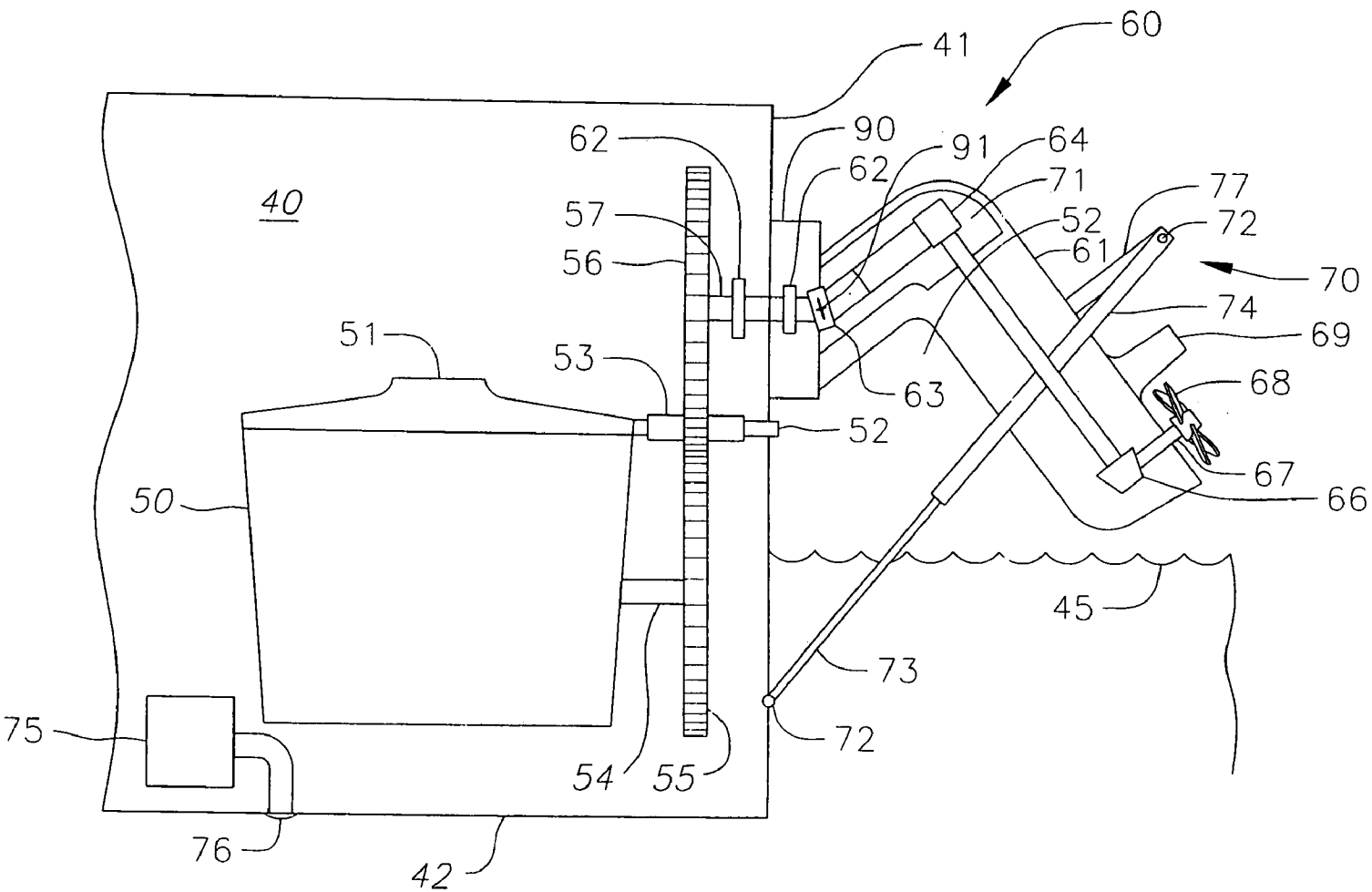
FIG. 5 is a side view of a further embodiment of an improved stern drive wherein the stern drive is in a substantially horizontal position.

Alternately, the engine 50 may be placed in a higher position within the vessel 40 to match the raised placement of the stern drive 60, as shown in FIG. 4. In this embodiment, the engine driveshaft 54 extends from the engine 50 and connects to a flywheel 55. The flywheel 55 connects to an upper driveshaft 57. In this manner the mechanical linkages between the engine 50 and the stern drive 60 can be the same simple components as shown in the prior art FIG. 1, while still allowing for a raised placement of the stern drive 60 on the transom 41. FIG. 5 shows a side view of a further embodiment of an improved stern drive wherein the stern drive 60 is in a substantially horizontal position.

Figure 6:
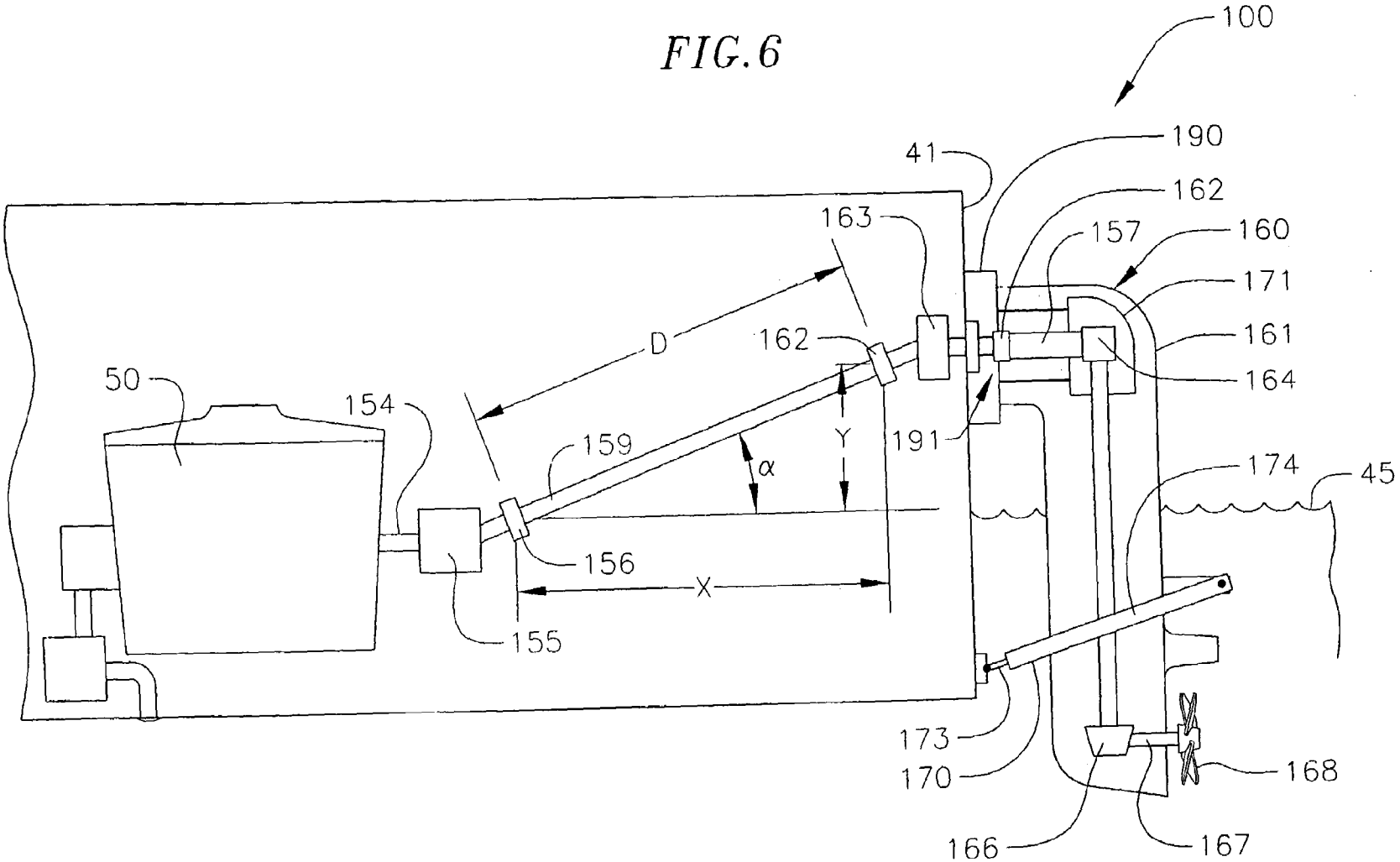
FIG. 6 is a side view of an improved inboard/outboard system constructed in accordance with the teachings of the present disclosure.
Figure 7:
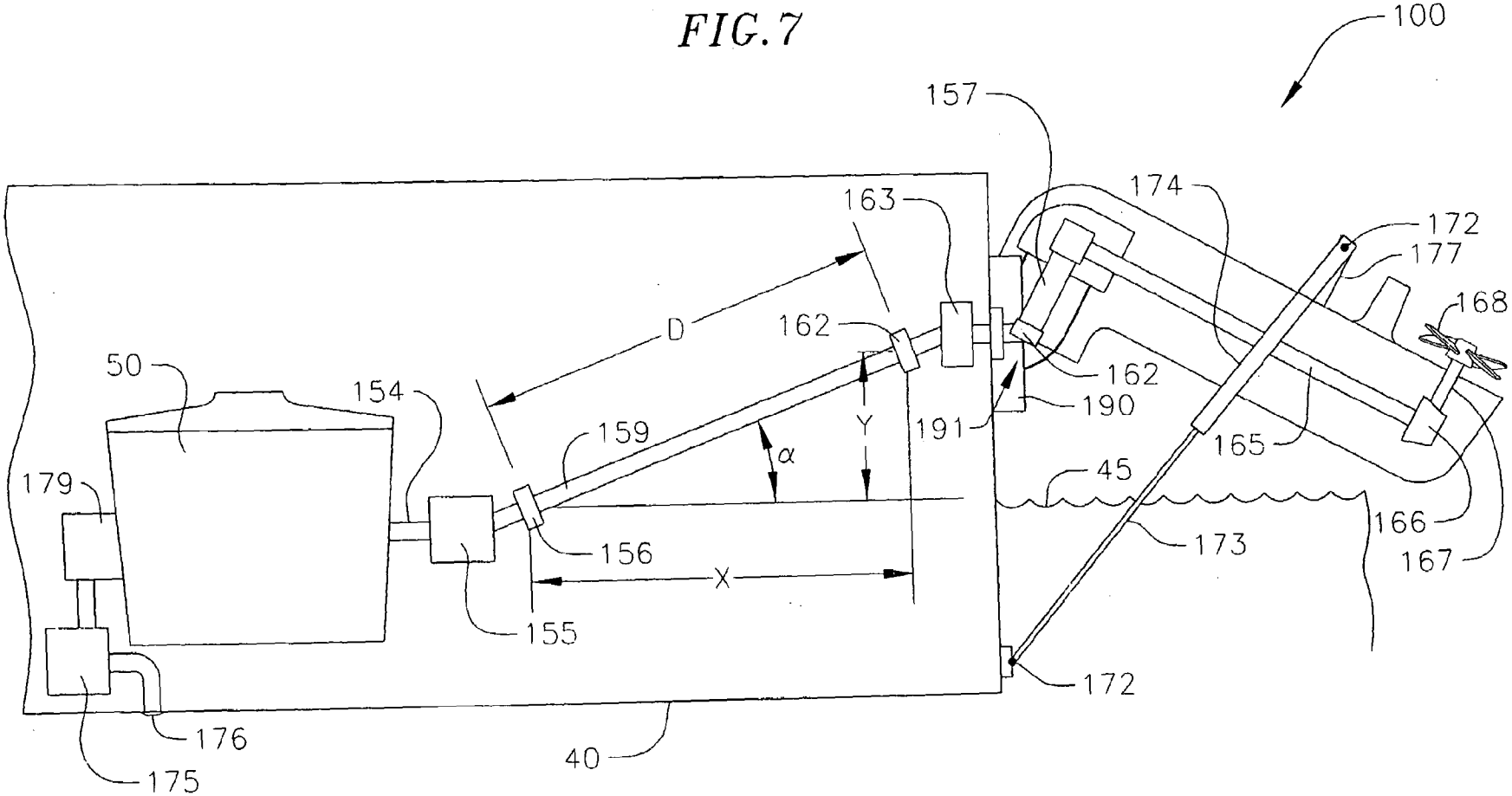
FIG. 7 is a side view of the stern drive of FIG. 6 shown with the stern drive pivoted out of the water.

FIGS. 6 and 7 show an I/O system 100 constructed in accordance with the teachings of another embodiment of the present disclosure. A stern drive 160 of the I/O system 100 includes a mounting plate 190, by which the stern drive 160 is mounted to and supported by the transom 41. The stern drive 160 includes a housing 161, in which componets of the stern drive 160 are supported and protected from exposure to water. As described above and is known to one of ordinary skill in the art, the stern drive 160 can include a gimble unit 162 or other suitable means interposed between the stern drive mounting plate 190 and the housing 161 that allows the housing 161 to pivot in relation to the stern drive mounting plate 190 about a pivot 191.

The I/O system 100 includes an upper driveshaft 157, which is positioned above the waterline 45 proximate to the transom 41. Accordingly, the stern drive 160 is positioned on the transom 41 so that the mechanical components in the top portion of the stern drive 160, including the gears 164 and any other joints or bearings (not shown) of the stern drive 160 lie in the same horizontal plane as the upper driveshaft 157. Accordingly, the upper drive shaft 157, the gears 164 and any other joints or bearings of the top portion of the stern drive 160 are at much less risk of damage from the salt water environment. A bellows 171 may be used enclosing these components as in the prior art to further reduce this risk.

An engine 150 is housed in the vessel 40 between the bow and the stern of the vessel 40. However, to provide a balanced load distribution for the vessel 40, the engine 150 of the I/O system 100 may be proximate to a mid-section of the vessel 40. For example, the engine 150 may be housed proximate to the center of gravity of the vessel 40. Accordingly, as shown in FIG. 6, the engine drive shaft 154 may be horizontally offset from the upper drive shaft 157 by a horizontal distance X and vertically offset from the upper drive shaft 157 by a vertical distance Y. The distances X and Y define an inclined distance D having an inclination angle $\alpha$ relative to a bottom of the vessel 40 and extending between the engine drive shaft 154 and the upper drive shaft 157. The distance D and the inclination angle $\alpha$ can vary depending on the location of engine drive shaft 154 relative to the upper drive shaft 157. As a result, the farther the engine 150 is positioned relative to the stern of the vessel 40, the longer the distance D and the shallower the angle $\alpha$ will be.

The engine drive shaft 154 is connected to a transmission shaft 159 by a lower joint 155. The transmission shaft 159 extends through the transom 41 and is connected to the upper drive shaft 157 by an upper joint 163. Thus, the transmission shaft 159 is inclined relative to both the engine drive shaft 154 and the upper drive shaft 157 and extends along or substantially parallel with the distance D. The lower joint 155 and/or the upper joint 163 may be a universal joint. However, either of the joints 155 and 163 may be any type of joint or a plurality of joints that can provide rotational coupling between the engine drive shaft 154 and the transmission shaft 159, and the transmission shaft 159 and the upper drive shaft 157, respectively, at the inclination angle $\alpha$. To provide stability for the transmission shaft 159 and support for the rotational coupling thereof with the engine drive shaft 154 and the upper drive shaft 157, the transmission shaft 159 may include a lower gimbal bearing 156 disposed proximate to the lower joint 155 and an upper gimbal bearing 162 disposed proximate to the upper joint 163.

The upper driveshaft 157 engages the gears 164. The gears 164 connect to a vertical shaft 165 which runs downward through the housing 161 of the stern drive 160, crossing the level of the waterline 45 to connect with gears 166. A propeller shaft 167 is connected to the gears 166, and is in turn connected to a propeller 168.

Referring to FIG. 7 an actuator 170 can rotate the lower portion of the stern drive 160 about the pivot 191. The actuator 170 is comprised of a piston 173 and a cylinder 174. In the present stern drive 160, the actuator 170 extends from the transom 41 to a cantilever 177 attached to the housing 161. The actuator 170 is attached to the transom 41 and the cantilever 177 using a pair of actuator hinges 172. The actuator hinges 172 allow the actuator 170 to change its pitch as it extends and contracts to adjust the position of the stern drive 160.

By attaching one end of the actuator 170 to the transom 41 directly or through an actuator mounting plate (not shown) rather than to the stern drive mounting plate 190 as in the prior art, and by attaching the other end of the actuator 170 to a cantilever 177, a much longer actuator 170 can be used than in the prior art. The elongated actuator 170 of the present invention can effectively reposition the stern drive 160 between an operative position below the waterline 45 and a maintenance position wherein the stern drive 160 is lifted partially or even completely above the waterline 45. Because the stern drive 160 is mounted on the transom 41 such that the top portion of stern drive 160 lies above the waterline 45, this rotation can result in the entire stern drive 160 being above the waterline 45 when the actuator 170 is fully extended. A water intake 176 may be routed directly through the hull of the vessel 40. A water pump 175 is connected to the water intake 176. The water pump 175 is in turn connected to a cooling system 179 connected to the engine 150.

While a particular form of the disclosure has been illustrated and described, it will be apparent that various modifications can be made without departing from the spirit and scope of the disclosure. Accordingly, it is not intended that the disclosure be limited, except as by the appended claims.

What is claimed is:

1. An improved marine vessel comprising:

a hull, the hull including a transom and having a predetermined waterline intersecting the hull and the transom;

an upper driveshaft disposed above the waterline;

an engine disposed within the hull including an engine drive shaft, the engine drive shaft disposed in the hull below the waterline;

a transmission shaft configured to operatively couple the engine drive shaft to the upper drive shaft, the transmission shaft extending in an upwardly inclined orientation relative to a bottom of the hull between the engine drive shaft and the upper drive shaft; and a stern drive attached to the transom, wherein the stern drive operatively couples the upper drive shaft to a propeller.

2. The vessel of claim 1, wherein the transmission shaft passes through the transom to couple to the upper drive shaft.

3. The vessel of claim 1, wherein the engine is disposed proximate to a center of gravity of the vessel.

4. The vessel of claim 1, wherein the transmission shaft is operatively coupled to the engine drive shaft by a lower universal joint and coupled to the upper drive shaft by an upper universal joint.

5. The vessel of claim 1, wherein the transmission shaft passes through lower gimbal bearing and passes through an upper gimbal bearing.

6. The vessel of claim 1, further comprising an actuator disposed between a housing of the stern drive and the transom of the vessel, the actuator configured to trim the attitude of the stern drive.

7. The vessel of claim 1, further comprising an actuator disposed between a housing of the stern drive and the transom of the vessel, wherein the actuator is configured to reposition the housing of the stern drive between an operative position below the predetermined waterline and a maintenance position wherein substantially all of the housing of the stern drive is lifted above the predetermined waterline.

8. An improved marine vessel comprising:

a hull, the hull including a transom and having a predetermined waterline intersecting the hull and the transom;

an upper driveshaft disposed above the waterline;

an engine disposed within the hull and having an engine driveshaft, the engine drive shaft disposed in the hull below the waterline, the engine drive shaft having a horizontal distance and a vertical distance relative to the upper drive shaft to define an upwardly inclined distance between the upper drive shaft and the engine drive shaft;

a transmission shaft extending along the inclined distance, wherein the transmission shaft operatively couples the engine drive shaft to the upper drive shaft; and a stern drive attached to the transom, the stern drive comprising:

a vertical shaft driven by the upper driveshaft;

a propeller shaft driven by the vertical shaft; and a housing attached to the transom and enclosing the vertical shaft.

9. The vessel of claim 8, wherein the transmission shaft passes through the transom to couple to the upper drive shaft.

10. The vessel of claim 8, wherein the engine is disposed proximate to a center of gravity of the vessel.

11. The vessel of claim 8, wherein the transmission shaft is operatively coupled to the engine drive shaft by a lower universal joint and coupled to the upper drive shaft by an upper universal joint.

12. The vessel of claim 8, wherein the transmission shaft passes through a lower gimbal bearing and passes through an upper gimbal bearing.

13. The vessel of claim 8, further comprising an actuator disposed between the housing of the stern drive and the transom of the vessel, the actuator configured to trim the attitude of the stern drive.

14. The vessel of claim 8, further comprising an actuator disposed between the housing of the stern drive and the transom of the vessel, wherein the actuator is configured to reposition the housing of the stern drive between an operative position below the predetermined waterline and a maintenance position wherein substantially all of the housing of the stern drive is lifted above the predetermined waterline.

15. A drive system for a marine vessel having a hull with a transom and a predetermined waterline intersecting the hull and the transom, the drive system comprising:

an engine disposed within the hull and having an engine drive shaft disposed below the waterline;

a stern drive having a propeller shaft coupled to a propeller, an upper driveshaft disposed above the waterline;

a transmission shaft configured to extend through an upwardly inclined distance defined by a horizontal distance and a vertical distance between the upper drive shaft and the engine drive shaft, the transmission shaft further configured to operatively couple the engine drive shaft to the upper drive shaft; and a vertical shaft configured to operatively couple to the upper drive shaft with a set of upper gears and configured to operatively couple to the propeller shaft with a set of lower gears.

16. The drive system of claim 15, wherein the engine is disposed proximate to a center of gravity of the vessel.

17. The drive system of claim 15, wherein the transmission shaft is operatively coupled to the engine drive shaft by a lower universal joint and coupled to the upper drive shaft by an upper universal joint.

18. The drive system of claim 15, wherein the transmission shaft passes through a lower gimbal bearing and passes through an upper gimbal bearing.

19. The drive system of claim 15, further comprising a mounting plate configured for attachment to the transom above the predetermined waterline, wherein the stern drive is attached to the mounting plate.

20. The drive system of claim 15, further comprising an actuator disposed between a housing of the stern drive and the hull, the actuator configured to trim the attitude of the stern drive.

* * * * *